US010720115B2

(12) United States Patent
Feng

(10) Patent No.: US 10,720,115 B2
(45) Date of Patent: Jul. 21, 2020

(54) DISPLAY DEVICE AND DRIVING METHOD THEREOF

(71) Applicant: InnoLux Corporation, Miao-Li County (TW)

(72) Inventor: Yu-Hsin Feng, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 123 days.

(21) Appl. No.: 15/916,619

(22) Filed: Mar. 9, 2018

(65) Prior Publication Data

US 2018/0261175 A1 Sep. 13, 2018

(30) Foreign Application Priority Data

Mar. 13, 2017 (CN) ..... 2017 1 0146751

(51) Int. Cl.
*G09G 3/36* (2006.01)
*G09G 3/3233* (2016.01)
*G09G 3/20* (2006.01)

(52) U.S. Cl.
CPC ..... *G09G 3/3648* (2013.01); *G09G 3/20* (2013.01); *G09G 3/3233* (2013.01); *G09G 2310/0243* (2013.01); *G09G 2310/0264* (2013.01); *G09G 2310/0267* (2013.01); *G09G 2320/041* (2013.01); *G09G 2320/043* (2013.01); *G09G 2330/026* (2013.01); *G09G 2370/14* (2013.01)

(58) Field of Classification Search
CPC combination set(s) only.
See application file for complete search history.

(56) References Cited

U.S. PATENT DOCUMENTS 10,338,727 B2 * 7/2019 Yu ..... G09G 3/3677
2004/0239610 A1 * 12/2004 Ishii ..... G09G 3/3611 345/100
2007/0002005 A1 * 1/2007 Kim ..... G09G 3/3655 345/103
2014/0118324 A1 5/2014 Chan et al.
2015/0220194 A1 * 8/2015 Lin ..... G06F 3/0416 345/173
2015/0269897 A1 * 9/2015 Kitsomboonloha ..... G09G 3/3648 345/205
2018/0012533 A1 * 1/2018 Lee ..... G09G 3/2092

FOREIGN PATENT DOCUMENTS

CN 103123779 A 5/2013

OTHER PUBLICATIONS

Chinese language office action dated Mar. 24, 2020, issued in application No. CN 201710146751.8.

* cited by examiner

*Primary Examiner* — Van N Chow
(74) *Attorney, Agent, or Firm* — McClure, Qualey & Rodack, LLP

(57) ABSTRACT

A display device includes: a display panel; a gate driving circuit formed at a side of the display panel; and a driving module outputting a plurality of clock signals to the gate driving circuit, wherein the driving module receives a feedback signal from the gate driving circuit and adjusts the clock signals according to the feedback signal.

17 Claims, 13 Drawing Sheets

DISPLAY DEVICE AND DRIVING METHOD THEREOF

CROSS REFERENCE TO RELATED APPLICATIONS

This Application claims priority of China Patent Application No. 201710146751.8, filed on Mar. 13, 2017, the entirety of which is incorporated by reference herein.

BACKGROUND OF THE DISCLOSURE

Field of the Disclosure

The present disclosure relates to a display device, and in particular to a driving method of a display device which can ensure that the display device boots properly or can extend the life time of the display device.

Description of the Related Art

When a display device having a gate driving circuit is booted (or activated), a conventional driving structure will detect the booting temperature and compensate for the voltage provided to the gate driving circuit according to the detected temperature.

However, there may be a difference between the reading detected by a temperature sensor and the real temperature of the panel, and this can cause the voltage compensation to be insufficient, making it difficult for the gate driving circuit to be activated correctly. Furthermore, after the gate driving circuit has been used for a long time, the minimum driving voltage may shift due to the accumulation of electric charges. However, the driving voltage is compensated for according to the temperature while the gate driving circuit is activated, so there exists a situation wherein the gate driving circuit cannot be activated normally even though the driving voltage has been compensated for.

Because it cannot be known whether or not the gate driving circuit is actually activated after the driving voltage is compensated for in the booting process by using the conventional structure, and thus the above issue with the gate driving circuit being activated abnormally cannot be addressed.

BRIEF SUMMARY OF THE DISCLOSURE

A detailed description is given in the following embodiments with reference to the accompanying drawings.

The purpose of the disclosure is to provide a display device and a driving method thereof, which can ensure that the display device boots properly or can extend the life time of the display device.

The disclosure provides a display device, comprising a display panel, a gate driving circuit, and a driving module. The gate driving circuit is disposed on the display panel and sequentially outputs a plurality of scan signals and at least one dummy scan signal. The driving module is electrically connected with the gate driving circuit, and outputs a plurality of clock signals to the gate driving circuit, wherein the driving module receives a feedback signal from the gate driving circuit and adjusts the clock signals according to the feedback signal.

The disclosure also provides a display device, comprising a first gate driving circuit, a second gate driving circuit, and a driving module. The first gate driving circuit is formed on a side of the display panel and sequentially outputs a plurality of scan signals and a first dummy scan signal. The second gate driving circuit is formed on an opposite side of the display panel and sequentially outputs the plurality of scan signals and a second dummy scan signal. The driving module outputs a plurality of clock signals to the first gate driving circuit and the second gate driving circuit. The driving module receives a first feedback signal from the first gate driving circuit and a second feedback signal from the second gate driving circuit. The driving module adjusts the clock signals according to the first feedback signal or the second feedback signal.

The disclosure also provides a driving method of a display device, wherein the display device comprises a display panel, a gate driving circuit disposed on the display panel, and a driving module. The driving module outputs a plurality of clock signals to the gate driving circuit, wherein the driving module receives a feedback signal from the gate driving circuit and adjusts the clock signals according to the feedback signal. The driving method comprises: activating the display device; gradually raising the voltage difference of the clock signals output from the driving module when the driving module receives a feedback signal with an abnormal pattern during an activation period of the display device until the driving module receives a feedback signal with a normal pattern; and shutting down the display device in cases where the driving module has not received a feedback signal with a normal pattern until the voltage difference of the clock signals is raised to a predetermined value.

According to the display device and the driving method thereof, the disclosure can search for a better booting driving voltage to prevent a situation wherein the display device cannot be booted correctly due to an insufficient boot driving voltage compensation according to the temperature sensor, or a situation wherein the display device cannot be booted correctly due to the minimum boot driving voltage rising after the display device has been used for a long time.

BRIEF DESCRIPTION OF THE DRAWINGS

The present disclosure can be more fully understood by reading the subsequent detailed description and examples with references made to the accompanying drawings, wherein.

DETAILED DESCRIPTION OF THE DISCLOSURE

Figure 1:
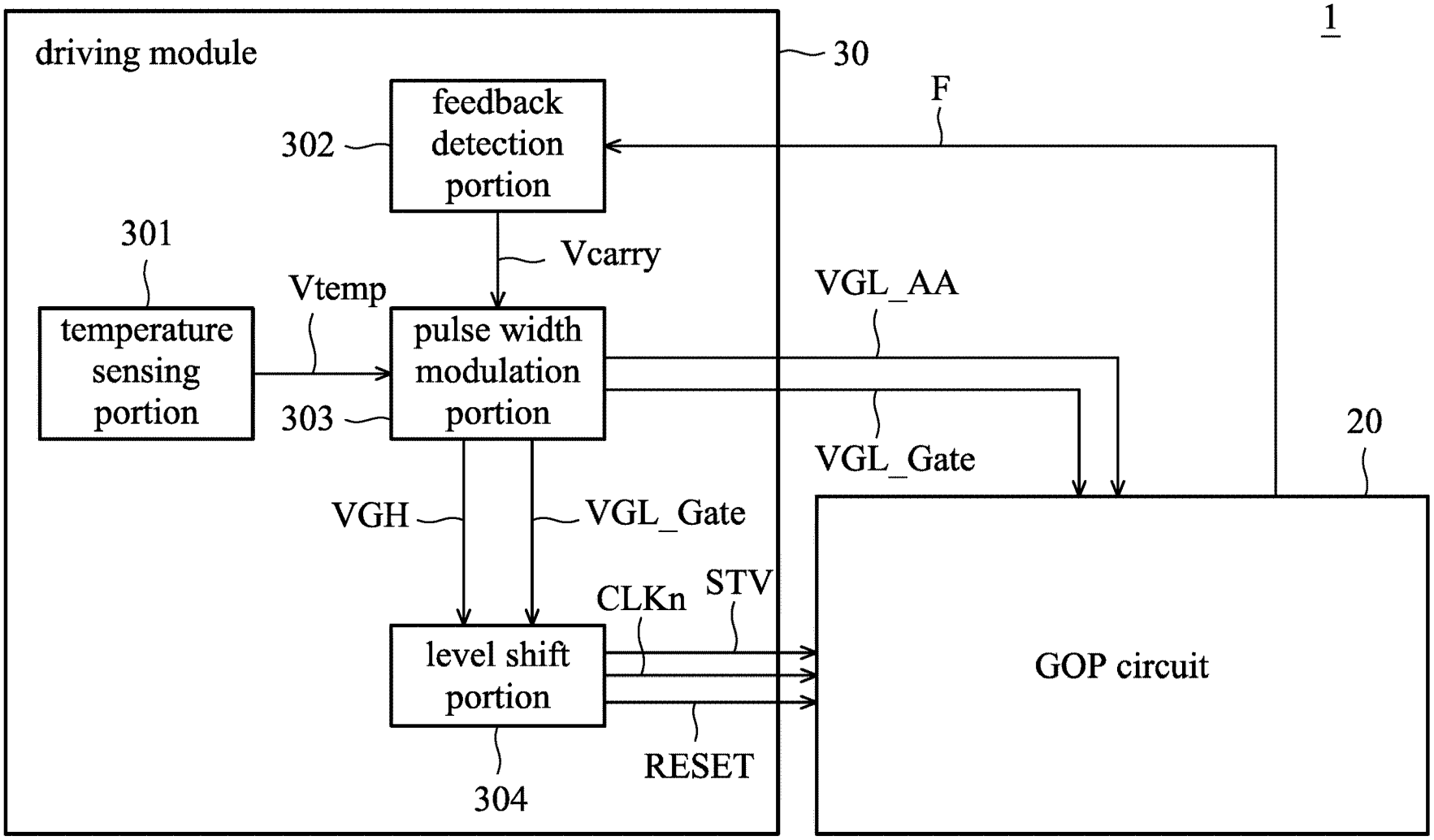
FIG. 1 is a diagram showing a driving structure of a gate driving circuit in a display device in accordance with Embodiment 1.

The following description is of modes of carrying out the disclosure. This description is made for the purpose of illustrating the general principles of the disclosure and should not be taken in a limiting sense. The scope of the disclosure is determined by reference to the appended claims.

In addition, the present disclosure may repeat reference numerals and/or letters in the various examples. This repetition is for the purpose of simplicity and clarity and does not in itself dictate a relationship between the various embodiments and/or configurations discussed. Furthermore, the shape, size, and thickness in the drawings may not be drawn to scale or simplified for clarity of discussion; rather, these drawings are merely intended for illustration.

Figure 2:
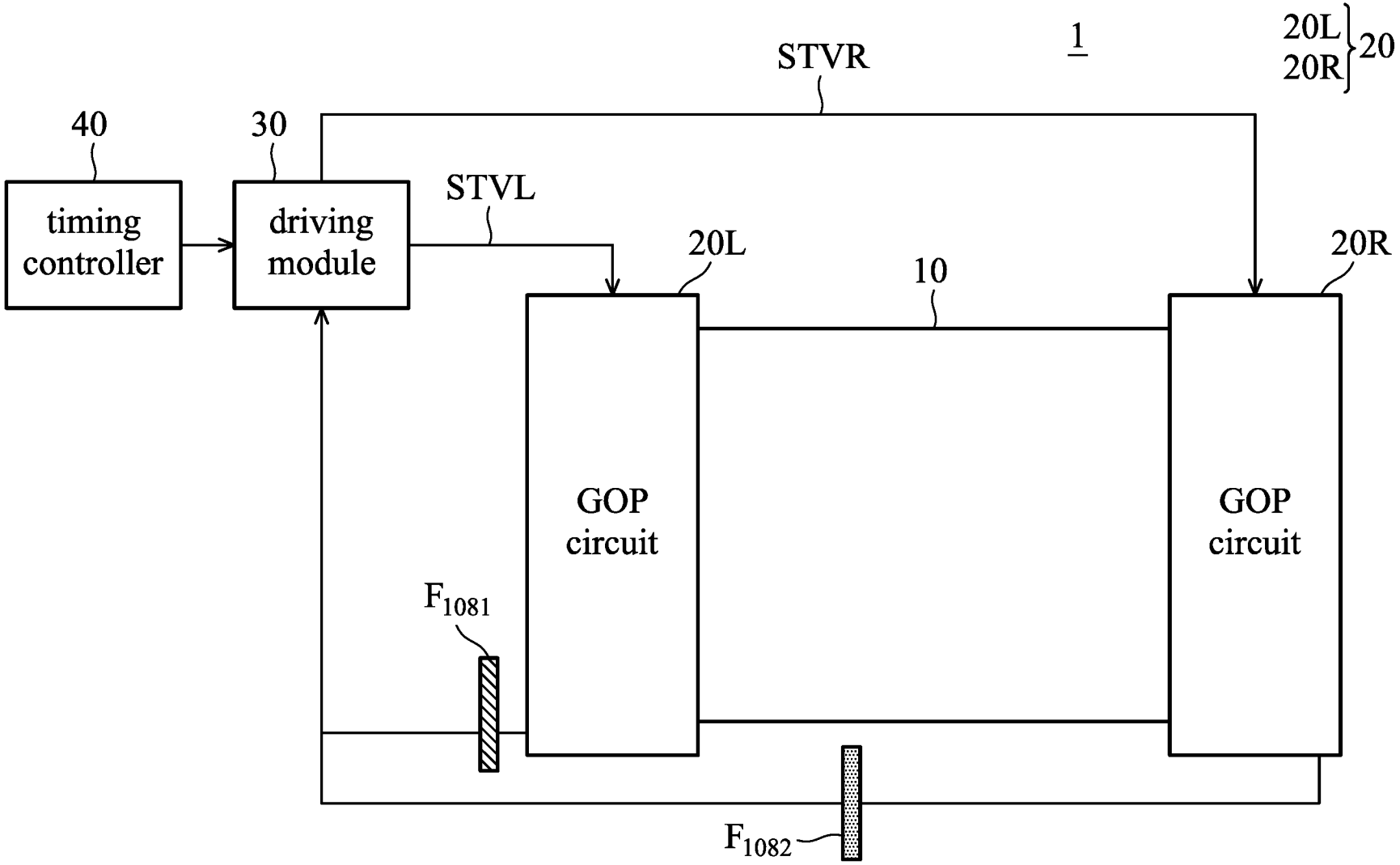
FIG. 2 is a schematic diagram showing an arrangement of the timing controller, the driving module, and the gate driving circuit in accordance with Embodiment 1.
Figure 3A:
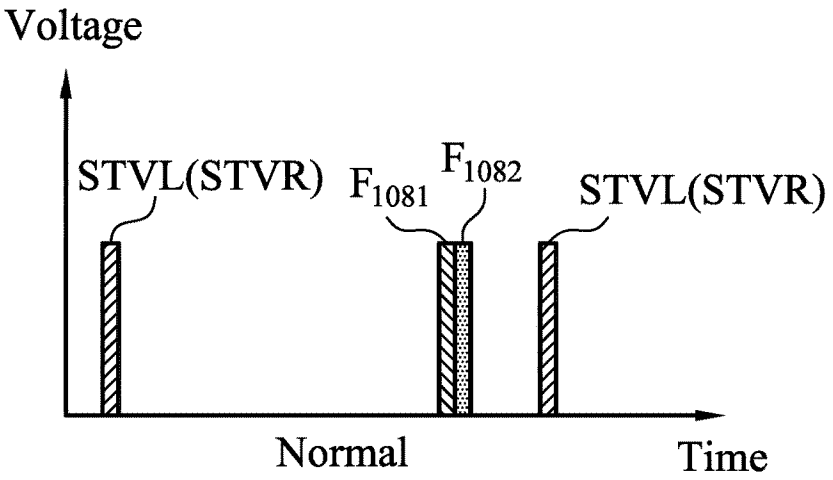
FIGS. 3A-3C are diagrams showing patterns of a normal feedback signal and abnormal feedback signals received by the driving module of FIG. 2.
Figure 3B:
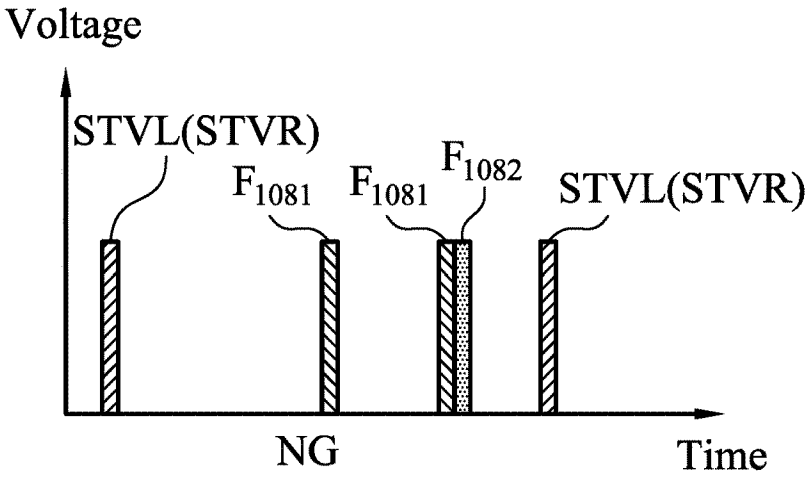
Figure 3C:
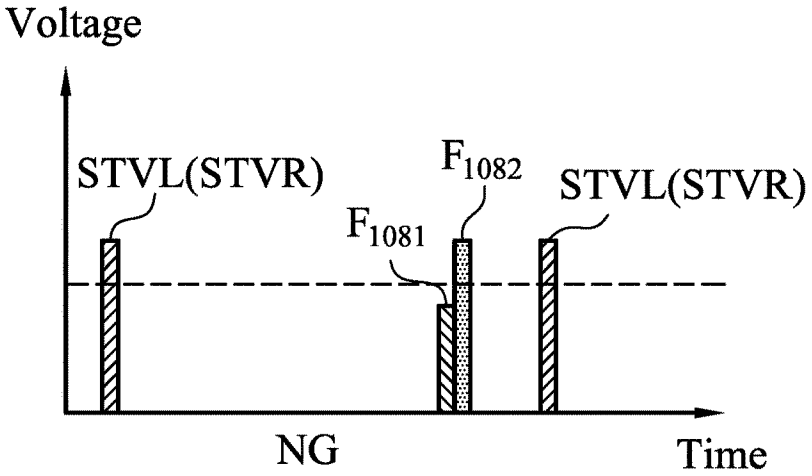
Figure 4:
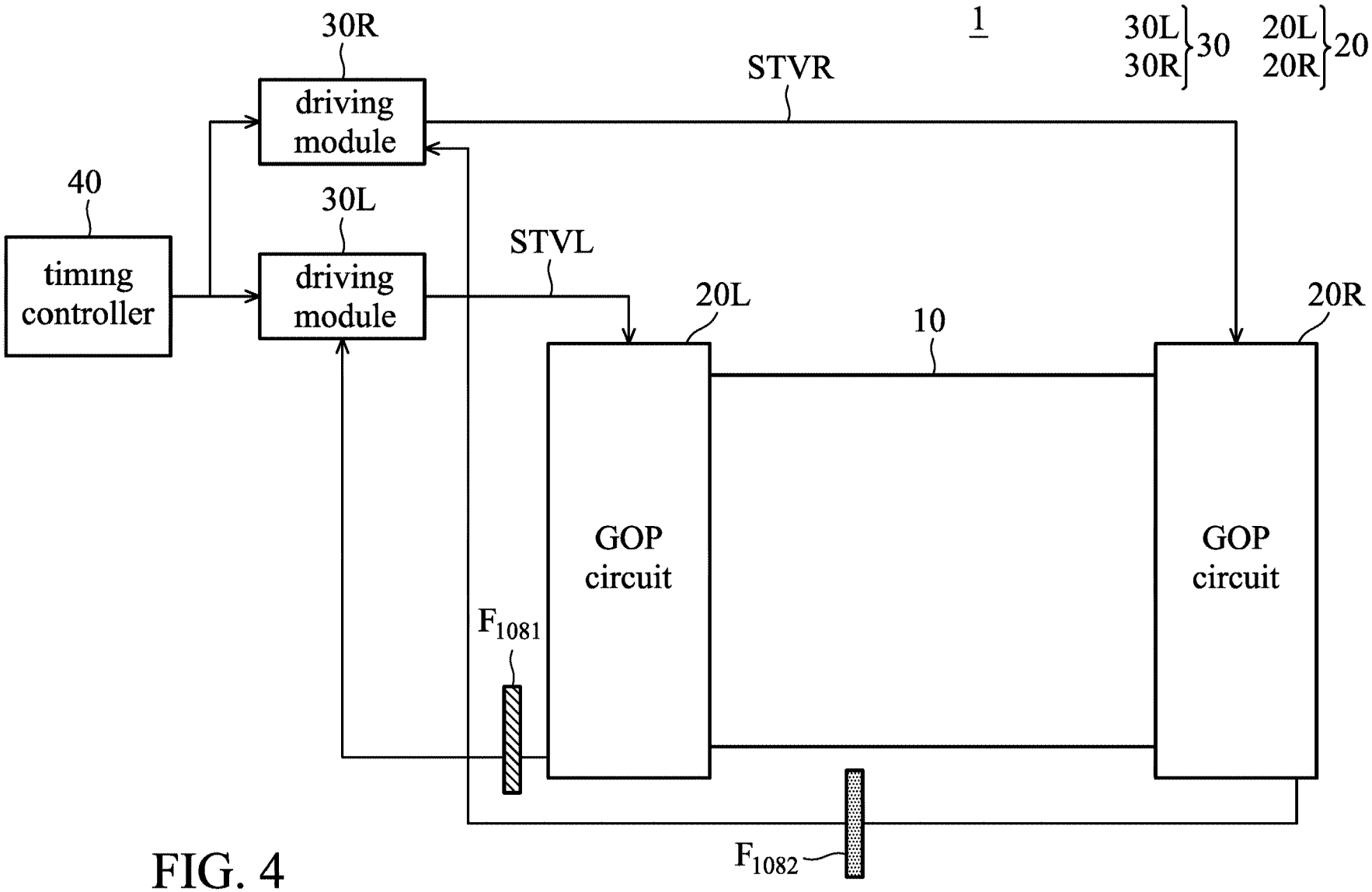
FIG. 4 is a schematic diagram showing another arrangement of the timing controller, the driving module, and the gate driving circuit in accordance with Embodiment 1.

FIG. 1 is a diagram showing a driving structure of a gate driving circuit in a display device in accordance with Embodiment 1. FIG. 2 is a schematic diagram showing an arrangement of the timing controller, the driving module, and the gate driving circuit in accordance with Embodiment 1. FIGS. 3A-3C are diagrams showing patterns of a normal feedback signal and abnormal feedback signals received by the driving module of FIG. 2. FIG. 4 is a schematic diagram showing another arrangement of the timing controller, the driving module, and the gate driving circuit in accordance with Embodiment 1.

As shown in FIGS. 1-2, a display device 1 in accordance with Embodiment 1 includes a display panel 10, a gate driving circuit 20, a driving module 30, and a timing controller 40. It is preferred that the gate driving circuit 20 is directly incorporated into the circuit (also called GOP circuit) on a substrate of the display panel 10. The gate driving circuit 20 is usually disposed on a side of the display panel 10. However, the need for large-sized display devices increases. In order to prevent the driving power of the signal send from the gate driving circuit 20 decreasing substantially when the signal reaches the opposite side of the large-sized display panel, two gate driving circuits 20 arranged respectively at opposite sides of the large-sized display panel have been often adopted by now. Two gate driving circuits 20 drive at the same time to ensure enough driving power. Therefore, in the present disclosure, though the gate driving circuit 20 is represented as one block, this block also includes cases where there are two gate driving circuits, for example, a gate driving circuit 20L disposed at one side of the display panel 10 and a gate driving circuit 20R disposed at the opposite side of the display panel 10, as shown in FIG. 2. Namely, the disclosure can be applied to the driving of a single-sided gate driving circuit, and to the driving of a double-sided gate driving circuit, but is not limited thereto. In an embodiment, the display panel 10 may be a flexible display device, a touch display device, or a curved display device. In some examples, the display panel 10 includes a display medium such as a liquid crystal material, an inorganic Light Emitting Diode (LED), an Organic Light Emitting Diode (OLED), a mini Light-Emitting Diode, a micro Light-Emitting Diode, Quantum Dots (QD), a fluorescence material, a phosphor material, etc. For example, the chip size of the light-emitting diode is in a range from about 300 μm to 10 mm, the chip size of the mini light-emitting diode is in a range from about 100 μm to 300 μm, and the chip size of the micro light-emitting diode is in a range from about 1 μm to 100 μm. The chip size of the disclosure is not limited thereto. The substrate material of the display panel can be glass, plastic, or other organic materials.

The driving module 30 is used for providing various driving signals to the gate driving circuit 20, and those driving signals drive the gate driving circuit 20 to sequentially send out gate line scan signals. The driving signals includes a start signal STV, clock signals CLKn, a reset signal RESET, a first low voltage level VGL_Gate, and a second low voltage level VGL_AA. The driving module 30 includes a temperature sensing portion 301, a feedback detection portion 302, a pulse width modulation portion 303, and a level shift portion 304. The timing controller 40 provides the driving module 30 power supply voltage and various time point control signals.

The temperature sensing portion 301 senses ambient temperature and outputs a temperature compensation voltage Vtemp corresponding to the sensed temperature, so as to compensate the gate driving circuit 20 which needs different driving voltages in situations wherein the display device 1 is located in a different environment. For example, when the display device 1 is located in an environment at a temperature lower than a default operation temperature, the gate driving circuit 20 needs a higher driving voltage to be activated, and the temperature sensing portion 301 outputs a higher temperature compensation voltage Vtemp. In Embodiment 1, the temperature sensing portion 301 is a part of the driving module 30, but the disclosure is not limited thereto. The temperature sensing portion 301 can be disposed separately from the driving module 30.

The feedback detection portion 302 receives a feedback signal F form the gate driving circuit 20 and sends a feedback compensation signal Vcarry in response to the feedback signal F. In Embodiment 1, the gate driving circuit 20 is a Gate-On-Panel (GOP) circuit and formed from shift registers connected in series. Each shift register sends a scan signal and then triggers the shift register at the next stage to sends a scan signal. If there is any break during the relay, the scan signals of the shift registers after the breakpoint cannot be sent out. In the other word, if that the scan signal for the last gate line is sent out can be checked, it means that the gate driving circuit 20 sends out every gate driving signal successfully. Based on the above reason, the gate driving circuit 20 in accordance with Embodiment 1 sends out the scan signal for the last gate line located in the display area of the display panel 10, and then sends out a dummy scan signal (a signal which is sent to the gate line outside the display area and doesn't drive display pixel) as the feedback signal F. The feedback signal F is used to determine whether the gate driving circuit 20 is activated (operated) correctly. When the feedback detection portion 302 doesn't receive a feedback signal F or receives an abnormal feedback signal F, the feedback detection portion 302 adjusts the feedback compensation voltage Vcarry output from the feedback detection portion 302. In other words, the feedback compensation voltage Vcarry adjusted by the feedback detection portion 302 may be smaller or larger than the pre-adjusted feedback compensation voltage Vcarry, and the adjusted feedback compensation voltage Vcarry may remain the same as the pre-adjusted feedback compensation voltage Vcarry when the gate driving circuit 20 is activated (operated) correctly.

The pulse width modulation portion 303 is used to provide voltage levels that are needed by each driving signal and control the duty cycle of each driving signal. In embodiment 1, the pulse width modulation portion 303 outputs three voltage levels: a high voltage level VGH, a first low voltage level VGL_Gate, and a second low voltage level VGL_AA. The high voltage level VGH is obtained from a default voltage plus the temperature compensation voltage Vtemp and the feedback compensation voltage Vcarry. Therefore, any variation of the temperature compensation voltage Vtemp and/or the feedback compensation voltage Vcarry will make the pulse width modulation portion 303 output a different value of the high voltage level VGH. The pulse width modulation portion 303 provides the first low voltage level VGL_Gate and the second low voltage level VGL_AA to the gate driving circuit 20, and provides the high voltage level VGH and the first low voltage level VGL_Gate to the level shift portion 304.

The level shift portion 304 uses the received high voltage level VGH and the received first low voltage level VGL_Gate to generate n sets of the clock signals CLKn (n is a positive integer) and outputs them to the gate driving circuit 20. Therefore, when the pulse width modulation portion 303 provides a higher high voltage level VGH, the level shift portion 304 outputs n sets of the clock signals CLKn with a larger voltage difference (that is to say, the driving capability is strong). On the other hand, when the pulse width modulation portion 303 provides a lower high voltage level VGH, the level shift portion 304 outputs n sets of the clock signals CLKn with a smaller voltage difference (that is to say, the driving capability is weak). In some examples, the voltage difference of the clock signals CLKn remain the same when the high voltage level VGH remains unchanged. Moreover, the level shift portion 304 also outputs the start signal STV and the reset signal RESET that the gate driving circuit 20 needs to the gate driving circuit 20.

Next, the patterns of a feedback signal are illustrated. In the structure of FIG. 2, the driving module 30 sends out a start signal STVL to the gate driving circuit 20L located at a side of the display panel 10, and a start signal STVR to the gate driving circuit 20R located at the opposite side of the display panel 10. The gate driving circuit 20L and the gate driving circuit 20R are activated synchronously. It is assumed that there are 1080 gate lines in the display panel. After outputting 1080 scan signals successively, the gate driving circuit 20L further outputs a first dummy scan signal $F_{1081}$ back to the driving module 30. On the other hand, after outputting 1080 scan signals and the first dummy scan signal $F_{1081}$ successively, the gate driving circuit 20R further outputs a second dummy scan signal $F_{1082}$ back to the driving module 30. The first dummy scan signal $F_{1081}$ and the second dummy scan signal $F_{1082}$ which are not overlapped in time are respectively taken as the feedback signal of the gate driving circuit 20L and the feedback signal of the gate driving circuit 20R, in other words, the first dummy scan signal $F_{1081}$ and the second dummy scan signal $F_{1082}$ are received at different time points, so that it is easy to observe the two signals separately.

Each of FIGS. 3A-3C shows the start signal STVL (STVR) and the first dummy scan signal $F_{1081}$ and the second dummy scan signal $F_{1082}$ in a single timing chart. The horizontal axis represents time and the vertical axis represents voltage. In cases where the pattern of the feedback signal is normal, as shown in FIG. 3A, the first dummy scan signal $F_{1081}$ and the second dummy scan signal $F_{1082}$ are received sequentially after a period of time starting from when the start signal STVL (STVR) is output. Then the next start signal STVL (STVR) is output for the scan of the next frame. In cases where the pattern of the feedback signal is abnormal, as shown in FIG. 3B, there are two first dummy scan signal $F_{1081}$ shown between two sequential start signal STVL (STVR). Namely, the first dummy scan signal $F_{1081}$ appears repeatedly, and it is apparently an abnormal status. In another case where the pattern of the feedback signal is abnormal, as shown in FIG. 3C, the received first dummy scan signal $F_{1081}$ is lower than a predetermined level. This may be an abnormal status where the gate driving circuit 20L has insufficient driving capacity. In addition to FIGS. 3B and 3C, it is also an abnormal status for the feedback signal to sometimes be received and sometimes not received. The abnormal status is not limited to the first dummy scan signal $F_{1081}$, when the pattern shown in FIGS. 3B and 3C occurs on the second dummy scan signal $F_{1082}$, this is also an abnormal status. The disclosure is not limited thereto. The normal pattern(s) of the feedback signal can be predetermined or defined as any pattern that allows the driving module to operate correctly. Moreover, the abnormal patterns of the feedback signal may be any pattern different from the normal pattern(s).

When an abnormal status of the received feedback signal is confirmed, the feedback detection portion 302 in accordance with Embodiment 1 adjusts the output feedback compensation voltage Vcarry. Therefore, the high voltage level VGH output from the pulse width modulation portion 303 is raised, and the voltage difference of the n set of clock signals CLKn output from the level shift portion 304 is varied in order to make the status of the feedback signal become normal.

According to the feedback mechanism described in Embodiment 1, an additional driving voltage adjustment besides temperature compensation is provided to prevent insufficiency of the temperature compensation. Furthermore, according to the feedback mechanism described in Embodiment 1, it can be ensured that the gate driving circuit is activated correctly, so as to prevent the situation where the gate driving circuit is not activated correctly because the minimum driving voltage is raised after the gate driving circuit has been used for a long time.

In addition to FIG. 2, FIG. 4 is a schematic diagram showing another arrangement of the timing controller, the driving module, and the gate driving circuit in accordance with Embodiment 1. In FIG. 2, one driving module 30 outputs the start signal STVL and the start signal STVR at the same time, and receives the first dummy scan signal $F_{1081}$ and the second dummy scan signal $F_{1082}$ as the feedback signals. In comparison with FIG. 2, the driving module 30 in FIG. 4 is divided into two driving modules 30L and 30R. The driving module 30L and the driving module 30R are connected to the timing controller 40. The driving module 30L outputs the start signal STVL to the gate driving circuit 20L located at a side of the display panel 10 and receives the first dummy scan signal $F_{1081}$ from the gate driving circuit 20L. The driving module 30R outputs the start signal STVR to the gate driving circuit 20R located at the opposite side of the display panel 10 and receives the second dummy scan signal $F_{1082}$ from the gate driving circuit 20R. The first dummy scan signal $F_{1081}$ and the second dummy scan signal $F_{1082}$ are the feedback signals. Although being different from FIG. 2, the arrangement shown in FIG. 4 belongs to the structure of Embodiment 1 shown in FIG. 1. Therefore, the operation scheme of FIG. 4 is the same as those of FIGS. 1 and 2.

Figure 5:
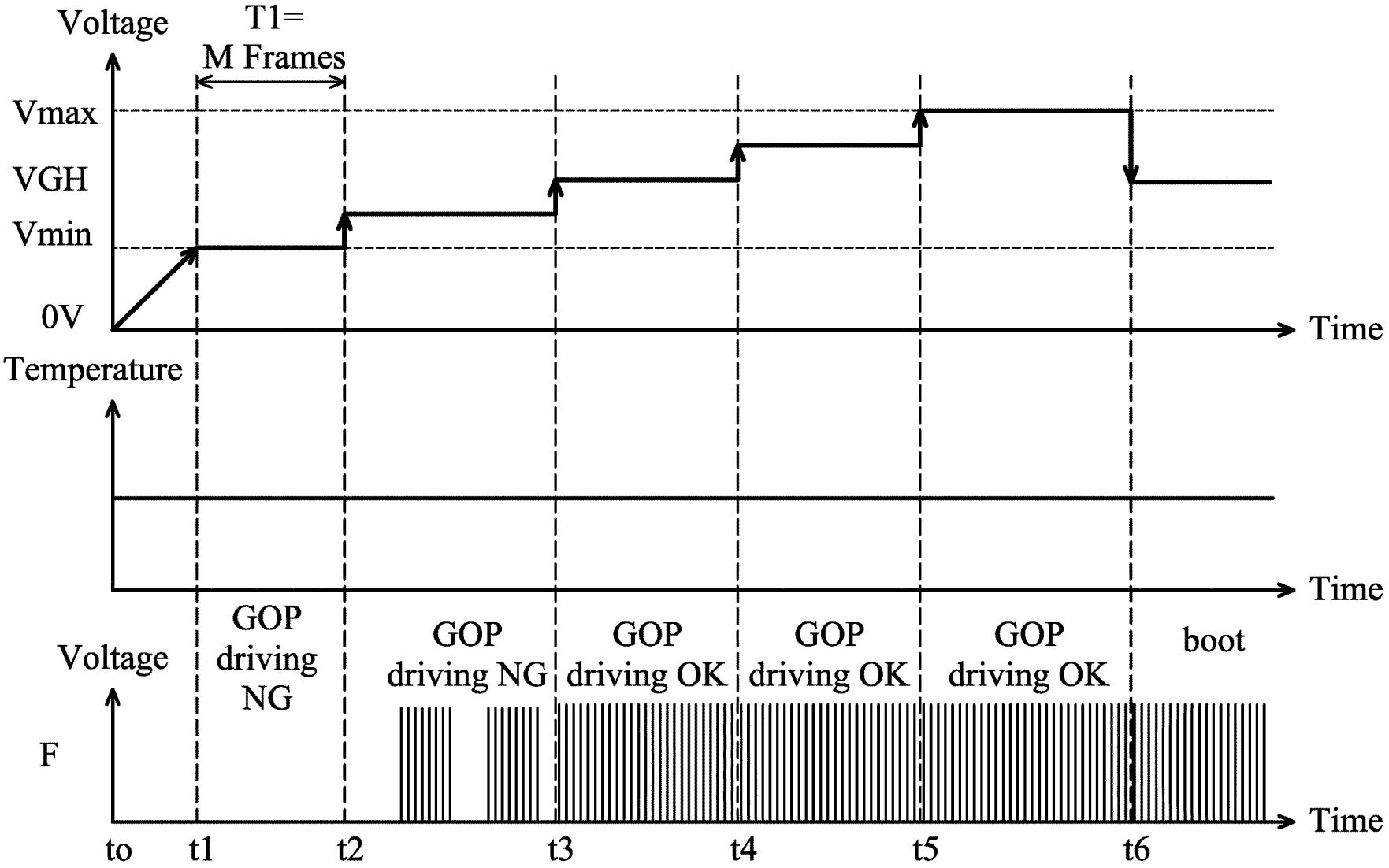
FIG. 5 is a timing chart showing that the driving voltage is adjusted according to the feedback signal in the activation period in accordance with Embodiment 1.
Figure 6:
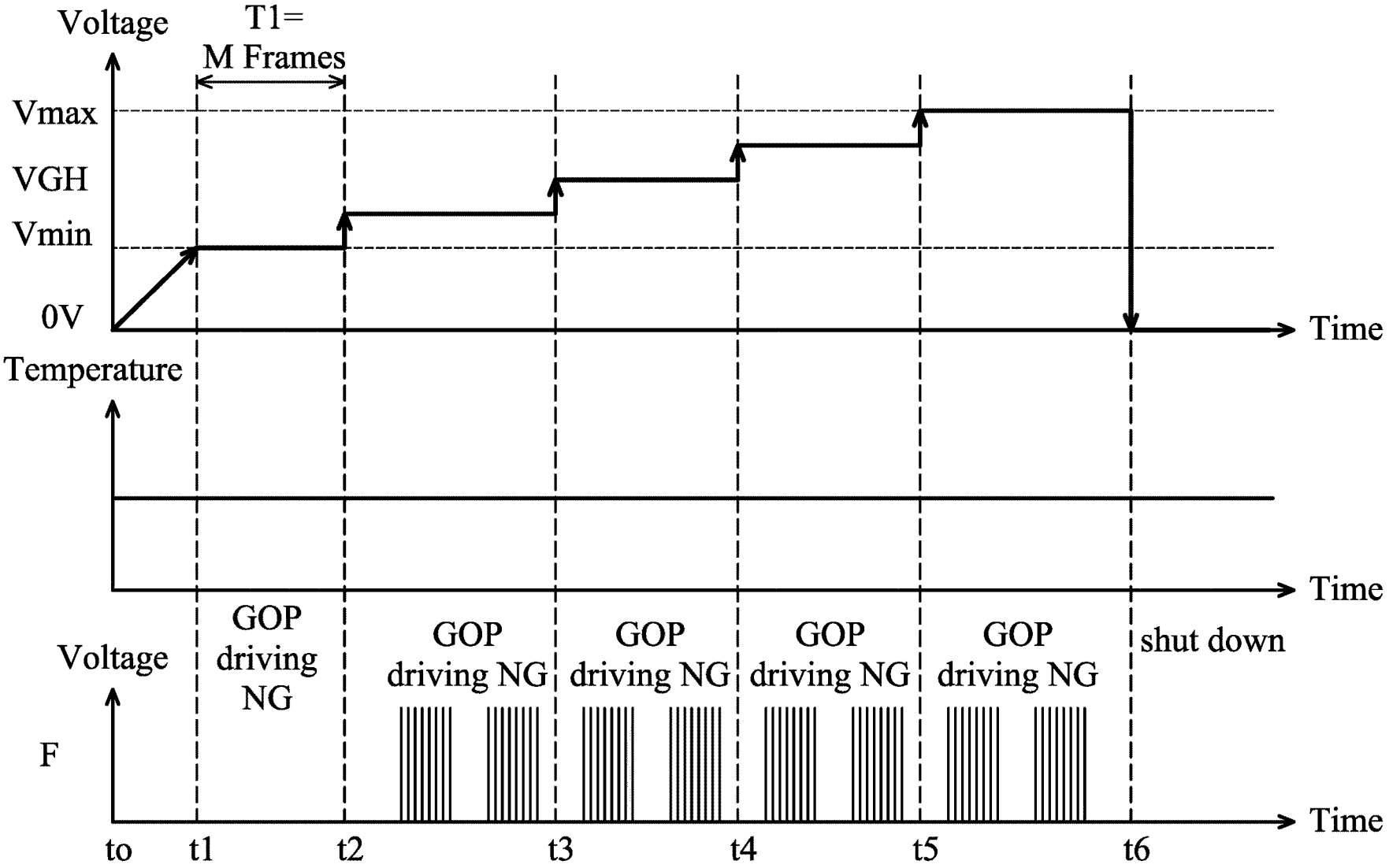
FIG. 6 is another timing chart showing that the driving voltage is adjusted according to the feedback signal in the activation period in accordance with Embodiment 1.

Next, operation patterns of the display device of Embodiment 1 during an activation period are described. FIG. 5 is a timing chart showing that the driving voltage is adjusted according to the feedback signal in the activation period in accordance with Embodiment 1. FIG. 6 is another timing chart showing that the driving voltage is adjusted according to the feedback signal in the activation period in accordance with Embodiment 1. In FIGS. 5 and 6, there are three small schemes from top to bottom. The top scheme is a timing chart of the high voltage level VGH, wherein the vertical axis represents voltage. The middle scheme is a timing chart of the ambient temperature, wherein the vertical axis represents temperature. The bottom scheme is a timing chart of the feedback signal F, wherein the vertical axis represents voltage.

In the activation (booting) pattern shown in FIG. 5, when the activation starts (at time point t0), the high voltage level VGH is increased to a minimum driving voltage value Vmin at time point t1. When the high voltage level VGH is at the minimum driving voltage value Vmin, the gate driving circuit 20 is driven for the time interval T1 until time point t2. Here, the time interval T1 is equal to a time period of M frames (M is a positive integer). Namely, the gate driving circuit 20 scans from the first gate line to the last gate line M times. In this embodiment, in a frame period the driving circuit generates a first dummy scan signal $F_{1081}$ as the feedback signal. Therefore, M feedback signals F should be received in the period between time point t1 and time point t2. If there is no feedback signal F in this period, this means that the gate driving circuit 20 is not activated successfully. Next, at time point t2, the feedback compensation voltage Vcarry is increased to raise the high voltage level VGH, and the gate driving circuit 20 is also driven for the time interval T1 until time point t3. In the period between time point t2 and time point t3, there are a number of feedback signals F but the total number of the feedback signals F is not M. This is an unstable status where sometimes the feedback signal F is received and sometimes the feedback signal F is not received. The gate driving circuit 20 is not activated successfully either. At time point t3, the feedback compensation voltage Vcarry is increased once again to raise the high voltage level VGH, and the gate driving circuit 20 is also driven for the time interval T1 until time point t4. In the period between time point t3 and point t4, M feedback signals F are received. This means that the gate driving circuit 20 is activated successfully. Although the gate driving circuit 20 is activated successfully, the high voltage level VGH in Embodiment 1 is still increased at time point t4 and time point t5 and drives for the time interval T1, respectively. This makes sure that M feedback signals F can be received for every time interval T1. In FIG. 5, the high voltage level VGH is increased to a maximum driving voltage value Vmax at time point t5, and is optionally decreased to a voltage level that is enough to drive the gate driving circuit 20 successfully (M feedback signals F can be ensured) at time point t6. In this Embodiment 1, the high voltage level VGH is decreased at time point t6 to the voltage level that is supplied during the period between time point t3 and t4. Then this voltage level is kept to drive the gate driving circuit 20. The activation (booting) process of the gate driving circuit 20 is finished.

In the activation (booting) pattern shown in FIG. 6, similar to FIG. 5, after the high voltage level VGH is increased to the minimum driving voltage value Vmin at time point t1, the high voltage level VGH is increased once at each time interval T1 (at time points t2, t3, t4, and t5 respectively). The increasing operation of the high voltage level VGH is continued until the high voltage level VGH reaches a predetermined value. In this embodiment, the predetermined value is the maximum driving voltage value Vmax. The difference between FIG. 6 and FIG. 5 is that the driving module 30 cannot receive complete M feedback signals F during any time interval T1. This means the high voltage level VGH cannot activate the gate driving circuit 20 in an allowable voltage range. The gate driving circuit 20 is dysfunctional. To prevent the gate driving circuit 20 from burning, the high voltage level VGH is dropped to OV at time point t6 to stop the activation process (shutting down).

Figure 7:
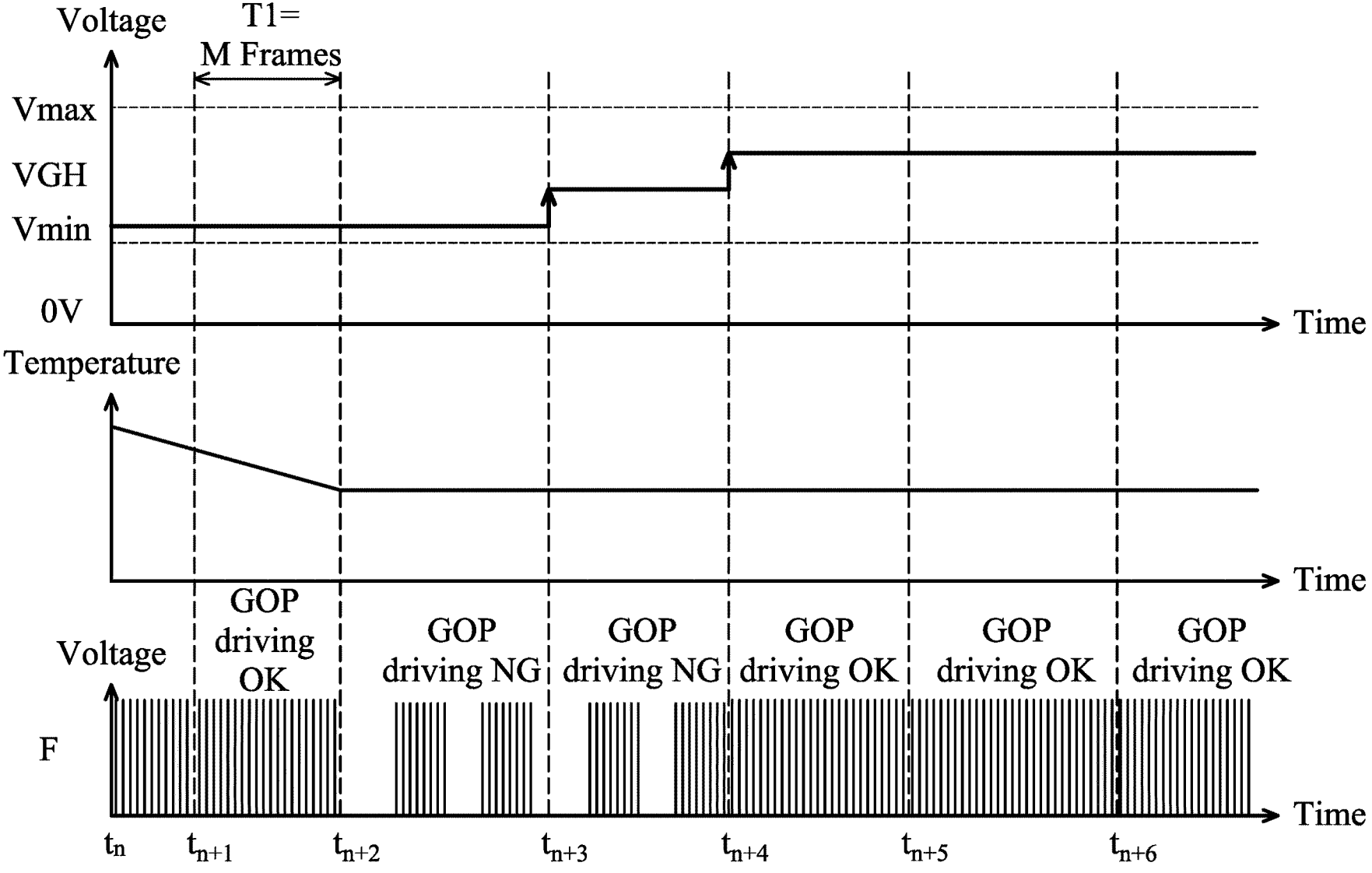
FIG. 7 is a timing chart showing that the driving voltage is adjusted according to the feedback signal in the operation period in accordance with Embodiment 1.

Next, operation patterns of the display device of Embodiment 1 under a temperature variation during an operation period are described. FIG. 7 is a timing chart showing that the driving voltage is adjusted according to the feedback signal in the operation period in accordance with Embodiment 1. In the operation period, the high voltage level VGH is maintained at a lower value in the beginning, and the feedback signal F is sent back to the driving module 30 correctly. At time point tn, the temperature of the operation environment starts to decrease continuously. During the time interval T1 between time point tn+1 and time point tn+2, the driving module 30 still normally receives M feedback signals F while high voltage level is not varied (when temperature variation is less than the minimum variation value that can be sensed by the temperature sensing portion 301, the temperature sensing portion 301 may not compensate the high voltage level VGH). During the interval T1 between time point tn+2 and time point tn+3, although the temperature has stopped decreasing, the driving module 30 doesn't receive M feedback signals F as an abnormal pattern. This means that the gate driving circuit 20 cannot be driven correctly at this temperature. Therefore, at time point tn+3, the feedback compensation voltage Vcarry is increased to rise to the high voltage level VGH, and the gate driving circuit 20 is also driven for interval T1 until time point tn+4. However, during the interval T1 between time point tn+3 and time point tn+4, the driving module 30 still receives feedback signals F less than M. Therefore, at time point tn+4, the feedback compensation voltage Vcarry is increased once again to rise to the high voltage level VGH, and the gate driving circuit 20 is also driven for interval T1 until time point tn+5. During the interval T1 between time point tn+4 and time point tn+5, the driving module 30 receives M feedback signals F. This means that the gate driving circuit 20 is driven correctly. Therefore, in this embodiment, this value of the high voltage level is kept to drive the gate driving circuit 20 hereafter.

According to the driving schemes shown in FIGS. 5-7, it should be understood that during the activation period and the operation period of the display device the driving voltage can be adjusted along with the variation of the feedback signal(s), so as to ensure the gate driving circuit can be activated or driven correctly. The aforementioned operation patterns are summarized below to illustrate a corresponding driving method for the display device of Embodiment 1.

Figure 8:
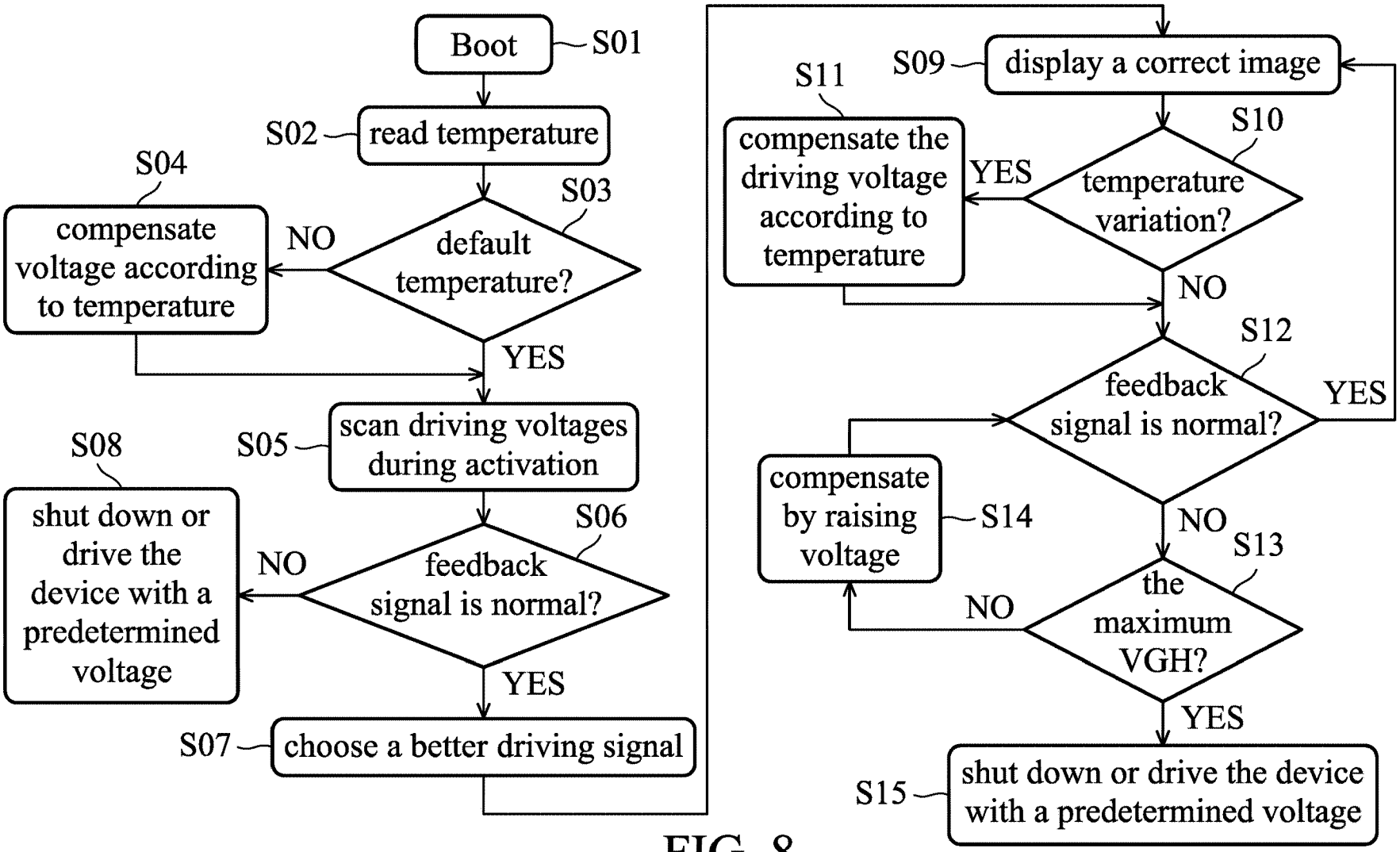
FIG. 8 shows a driving method utilized in the display device shown in Embodiment 1.

FIG. 8 shows a driving method utilized in the display device shown in Embodiment 1. First, the display device 1 is activated (step S01). When the display device 1 is activated, the temperature sensing portion 301 senses ambient temperature (step S02), and determines whether the present temperature is a default temperature (step S03). If the present temperature deviates from the default temperature, the temperature sensing portion 301 outputs the temperature compensation voltage Vtemp to the pulse width modulation portion 303 according to the present temperature (step S04), and the procedure proceeds to step S05. If the present temperature is the default temperature, temperature compensation will be unnecessary, and the procedure proceeds to step S05. Next, as shown in FIGS. 5 and 6, the feedback compensation voltage Vcarry is gradually increased during the activation period to scan for a better activation voltage (step S05). Whether a normal feedback signal pattern can be obtained during the driving-voltage-scan period is checked (step S06). If a normal feedback signal pattern is obtained, a better activation voltage is utilized to drive the gate driving circuit 20 (step S07). If a normal feedback signal pattern cannot be obtained during the driving-voltage-scan period, the panel is dysfunctional and the display device is shut down to prevent it from burning (step S08). When a better driving voltage is chosen, the gate driving circuit 20 can be driven correctly. The display device 1 shows a correct image and the activation procedure of the display device 1 is finished (step S09).

During the operation period, the temperature sensing portion 301 continuously senses ambient temperature to check whether the present temperature varies from the previous temperature (step S10). If there is a temperature variation, the temperature sensing portion 301 outputs the temperature compensation voltage Vtemp to the pulse width modulation portion 303 according to the present temperature (step S11), and the procedure proceeds to step S12. If there is no temperature variation, temperature compensation will be unnecessary, and the procedure proceeds to step S12. Next, whether the normal feedback signal pattern is obtained is checked (step S12). If the normal feedback signal pattern is obtained, temperature compensation will be enough to compensate the driving voltage, and the procedure proceeds back to step S09. If the normal feedback signal pattern is not obtained, as shown in FIG. 7, the driving voltage compensated with temperature compensation will be still insufficient, and the driving voltage needs to be further raised. At step S13, whether the present driving voltage (or the high voltage level VGH) reaches the maximum value is checked. If the driving voltage has not reached the maximum value, the feedback compensation voltage Vcarry will be increased to compensate the driving voltage (step S14), and then the procedure proceeds back to step S12 to check whether the normal feedback signal pattern is obtained (step 12). If the driving voltage has reached the maximum value, the driving voltage cannot be further raised. The panel may be dysfunctional and the display device is shut down or driven by a lower predetermined voltage to prevent it from burning (step S15).

In the above driving method for the display device, the activation procedure and the operation procedure of the display device 1 are illustrated in detail. The gate driving circuit can be activated or driven correctly in either the activation period or the operation period.

Figure 9:
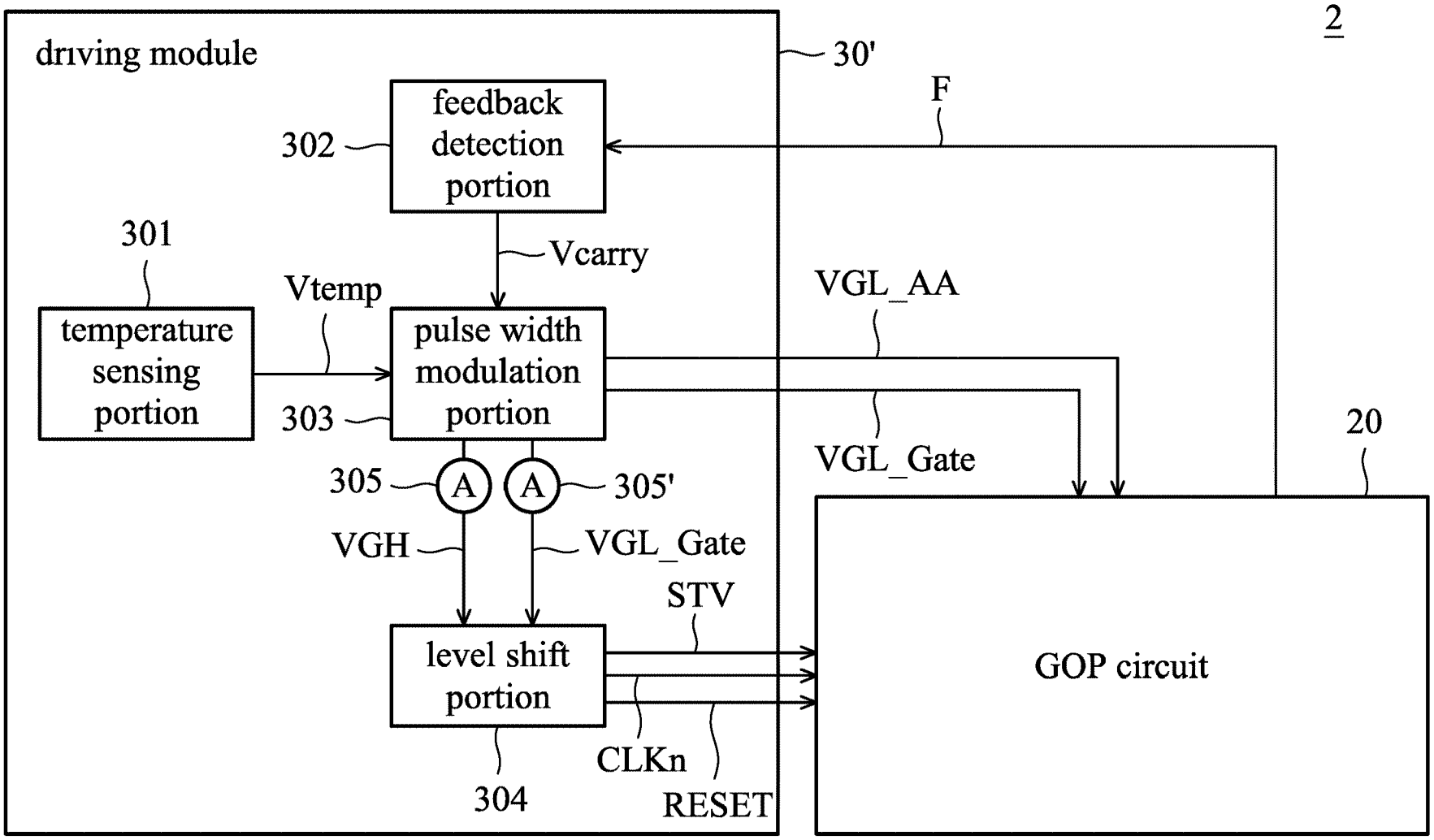
FIG. 9 is a diagram showing a driving structure of a gate driving circuit in a display device in accordance with Embodiment 2.

The disclosure further provides a solution to electric leakage of the gate driving circuit due to high temperature. FIG. 9 is a diagram showing a driving structure of a gate driving circuit in a display device in accordance with Embodiment 2. The display device 2 of Embodiment 2 has a driving module 30', which is different from the display device 1 of Embodiment 1. The remaining structure, arrangement, and variation of the display device 2 of Embodiment 2 are the same as the display device 1 of Embodiment 1. Therefore, the difference between Embodiment 2 and Embodiment 1 will be described below, and the description for the same portion is omitted.

In the driving module 30', a current meter 305 (or 305') is disposed between and electrically connected with the pulse width modulation portion 303 and the level shift portion 304. The current meter 305 is disposed on the path where the pulse width modulation portion 303 outputs the high voltage level VGH. The current meter 305' is disposed on the path where pulse width modulation portion 303 outputs the first low voltage level VGL_Gate. The function of Embodiment 2 can be implemented as long as at least one of the two current meters is disposed.

In Embodiment 2, in addition to the feedback signal F used to detect whether the gate driving circuit 20 is driven correctly, the current meter 305 (305') is used to further check whether the gate driving circuit 20 has an electric leakage. When the driving module 30' receives an abnormal feedback signal F pattern, the reason of the abnormal feedback signal F pattern may be insufficiency of the driving capacity of the driving signal, or the current of the driving signal surpasses the maximum allowable leakage current. Therefore, Embodiment 2 will utilize the current meter 305 (or 305') to check whether the current value surpasses a normal value (the maximum allowable leakage current), and determines whether the gate driving circuit 20 has an abnormal leakage.

Because the leakage current of an element is proportional to the voltage drop applied to the element, a way to lower the leakage current is lowering the voltage drop that is applied. Moreover, shortening the duration the voltage drop is applied to the element (it is equivalent to the duration current leaks) can also lower the average leakage current. Contrary to Embodiment 1, the way to lower the voltage drop that is applied to the element is decreasing the feedback compensation voltage Vcarry (the voltage difference of the clock signals CLKn is decreased while the high voltage level VGH is lowered). Therefore, the example of decreasing the feedback compensation voltage Vcarry is not taken in particular. The example of shortening the duration the voltage drop is applied to the element is shown in FIGS. 10A and 10B.

Figure 10A:
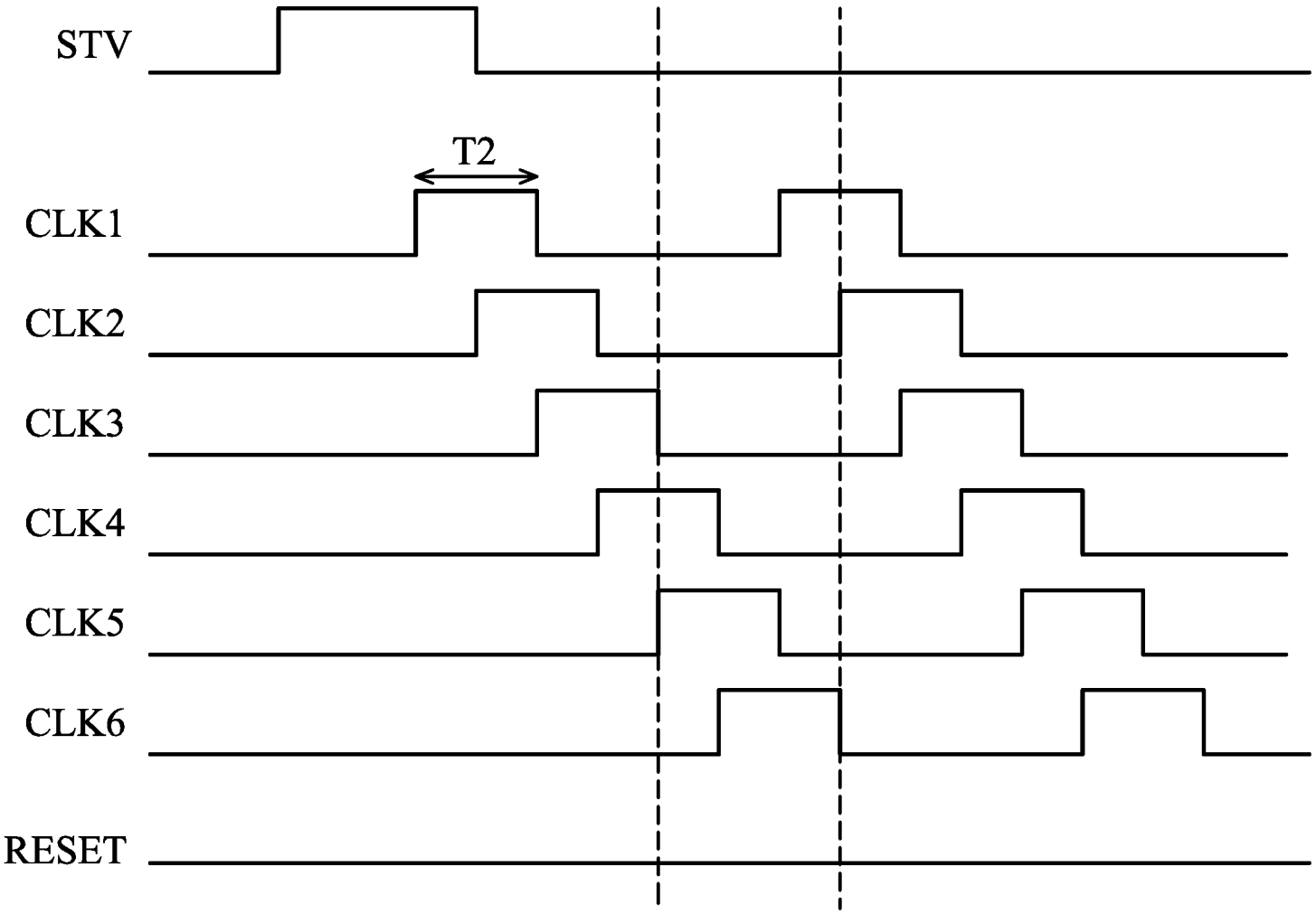
FIG. 10A is a timing chart showing before-adjusted clock signals output from the driving module in accordance with Embodiment 2.
Figure 10B:
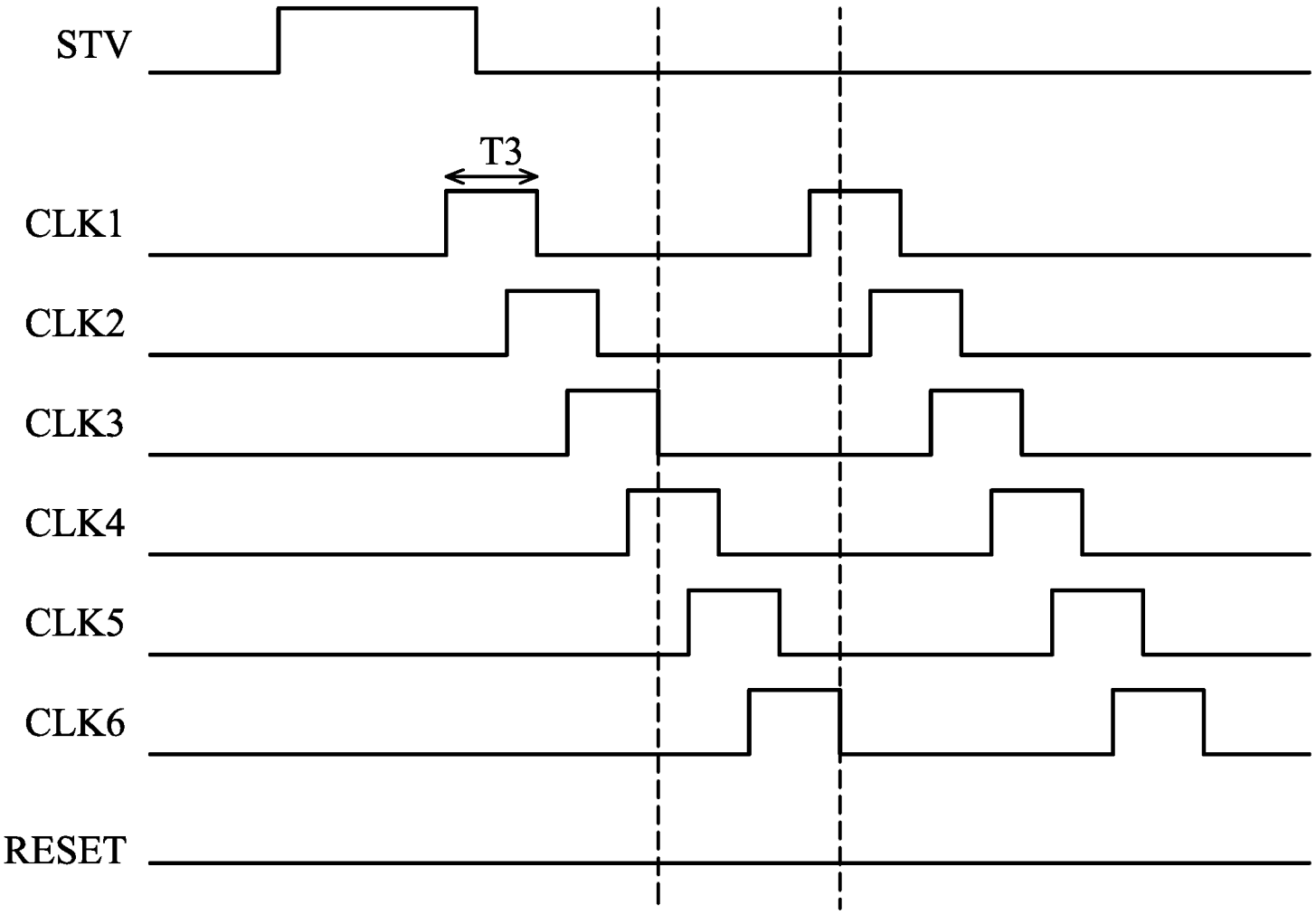
FIG. 10B is a timing chart showing after-adjusted clock signals output from the driving module in accordance with Embodiment 2.

FIG. 10A is a timing chart showing before-adjusted clock signals output from the driving module in accordance with Embodiment 2. FIG. 10B is a timing chart showing after-adjusted clock signals output from the driving module in accordance with Embodiment 2. In Embodiment 2, the driving module 30' outputs six clock signals CLK1~CLK6. Before the duration of the clock signals are adjusted, as shown in FIG. 10A the duration during which each clock signal CLK1~CLK6 is at high level is T2. However, in cases where the current meter 305 (or 305') determines that the gate driving circuit 20 has electric leakage, the pulse width modulation portion 303 adjusts the clock signals output from the level shift portion 304 to lower the current leakage. As shown in FIG. 10B, the duration during which each clock signal CLK1~CLK6 is at high level is shorten to T3. The high level period of the clock signal is shortened. Namely, the duty cycle of the clock signal is shortened. In the disclosure, the time point of the rising edge of the clock signal is delayed so as to shorten the duty cycle of the clock signal.

Next, the voltage compensation method disclosed in Embodiment 1 and the two solutions for current leakage disclosed in Embodiment 2 are combined as a driving method of the display device in accordance with Embodiment 2.

Figure 11:
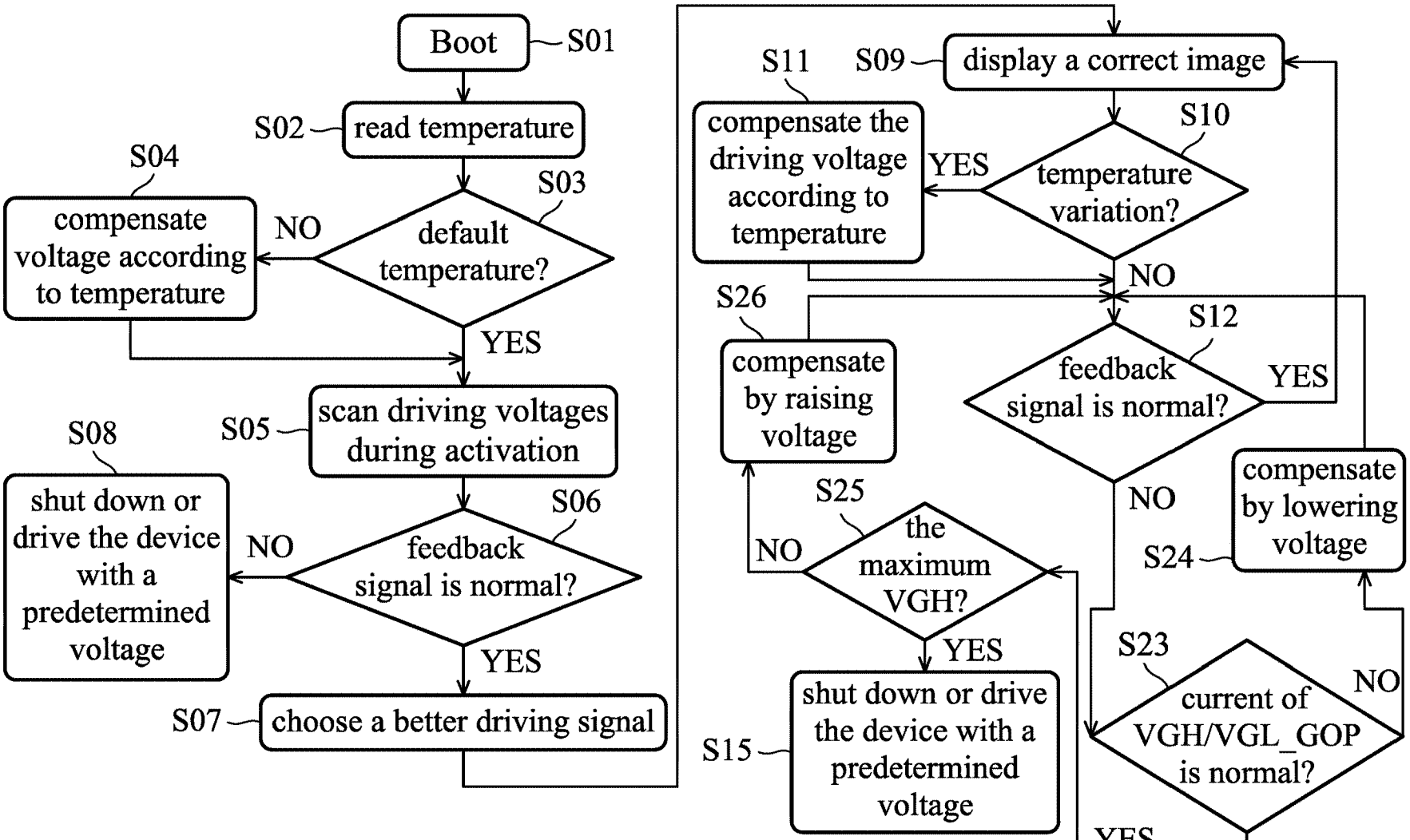
FIG. 11 shows a driving method utilized in the display device shown in Embodiment 2.

FIG. 11 shows a driving method utilized in the display device shown in Embodiment 2. In FIG. 11, the problem of current leakage is solved by lowering the voltage drop of the element as mentioned before. In the procedure, steps labeled with the same reference numerals as those in FIG. 8 mean the same operations as described in FIG. 8. First, the display device 1 is activated (step S01). When the display device 1 is activated, the temperature sensing portion 301 senses ambient temperature (step S02), and determines whether the present temperature is a default temperature (step S03). If the present temperature deviates from the default temperature, the temperature sensing portion 301 outputs the temperature compensation voltage Vtemp to the pulse width modulation portion 303 according to the present temperature (step S04), and the procedure proceeds to step S05. If the present temperature is the default temperature, temperature compensation will be unnecessary, and the procedure proceeds to step S05. Next, as shown in FIGS. 5 and 6, the feedback compensation voltage Vcarry is gradually increased during the activation period to scan for a better activation voltage (step S05). Whether a normal feedback signal pattern can be obtained during the driving-voltage-scan period is checked (step S06). If a normal feedback signal pattern is obtained, a better activation voltage will be utilized to drive the gate driving circuit 20 (step S07). If a normal feedback signal pattern cannot be obtained during the driving-voltage-scan period, the panel will be dysfunctional and the display device is shut down to prevent it from burning (step S08). When a better driving voltage is chosen, the gate driving circuit 20 can be driven correctly. The display device 1 shows a correct image and the activation procedure of the display device 1 is finished (step S09).

During the operation period, the temperature sensing portion 301 continuously senses ambient temperature to check whether the present temperature varies from the previous temperature (step S10). If there is a temperature variation, the temperature sensing portion 301 will output the temperature compensation voltage Vtemp to the pulse width modulation portion 303 according to the present temperature (step S11), and the procedure proceeds to step S12. If there is no temperature variation, temperature compensation will be unnecessary, and the procedure proceeds to step S12. Next, whether the normal feedback signal pattern is obtained is checked (step S12). If the normal feedback signal pattern is obtained, temperature compensation will be enough to compensate the driving voltage and the procedure proceeds back to step S09. If the normal feedback signal pattern is not obtained, the current meter 305 (or 305') will be further utilized to check whether the current of the high voltage level VGH or the current of the first low voltage level VGL_Gate is unusually high (step S23). If the current meter 305 (305') detects an abnormal current value, there may be current leakage. The feedback compensation voltage Vcarry is decreased to lower the voltage difference of the driving voltage (the clock signal CLKn). The current leakage is lowered as well (step S24), and the procedure proceeds back to step S12 to check again whether the normal feedback signal pattern is obtained. If the current meter 305 (305') detects a normal current value, the driving voltage will be insufficient and needs to be further increased. At step S25, whether the present driving voltage (or the high voltage level VGH) reaches the maximum value is checked. If the driving voltage has not reached the maximum value, the feedback compensation voltage Vcarry will be increased to compensate the driving voltage (step S26), and the procedure proceeds back to step S12 to check again whether the normal feedback signal pattern is obtained. If the driving voltage has reached the maximum value, the driving voltage cannot be further raised. The panel is dysfunctional and the display device is shut down or driven by a lower predetermined voltage to prevent it from burning (step S15).

Figure 12:
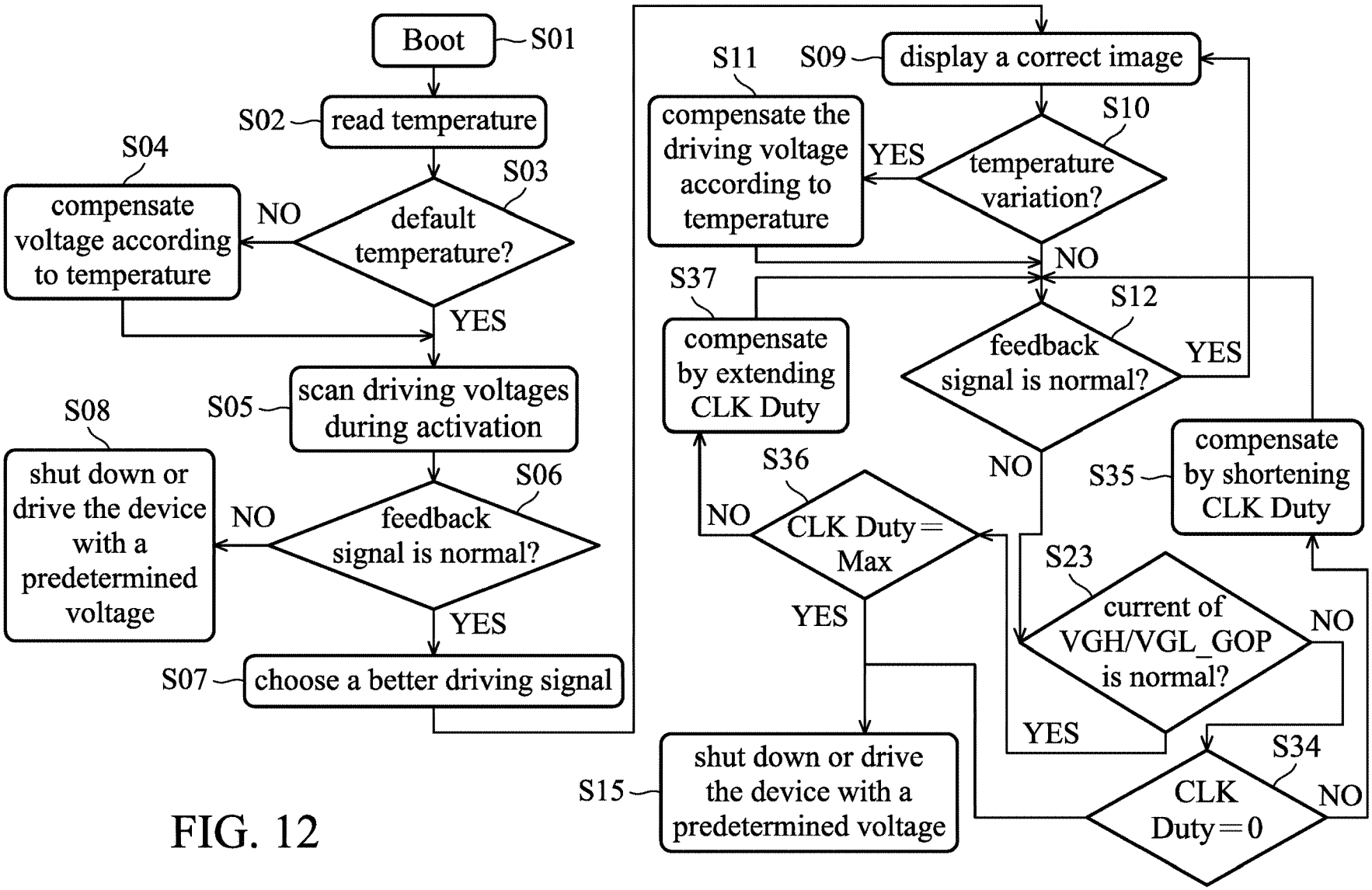
FIG. 12 shows another driving method utilized in the display device shown in Embodiment 2.

FIG. 12 shows another driving method utilized in the display device shown in Embodiment 2. In FIG. 12, the problem of current leakage is solved by shortening the duration the voltage applied the element as mentioned before. In the procedure, steps labeled with the same reference numerals as those in FIG. 8 mean the same operations as described in FIG. 8. First, the display device 1 is activated (step S01). When the display device 1 is activated, the temperature sensing portion 301 senses ambient temperature (step S02), and determines whether the present temperature is a default temperature (step S03). If the present temperature deviates from the default temperature, the temperature sensing portion 301 outputs the temperature compensation voltage Vtemp to the pulse width modulation portion 303 according to the present temperature (step S04), and the procedure proceeds to step S05. If the present temperature is the default temperature, temperature compensation will be unnecessary, and the procedure proceeds to step S05. Next, as shown in FIGS. 5 and 6, the feedback compensation voltage Vcarry is gradually increased during the activation period to scan for a better activation voltage (step S05). Whether a normal feedback signal pattern can be obtained during the driving-voltage-scan period is checked (step S06). If a normal feedback signal pattern is obtained, a better activation voltage will be utilized to drive the gate driving circuit 20 (step S07). If a normal feedback signal pattern cannot be obtained during the driving-voltage-scan period, the panel may be dysfunctional and the display device is shut down to prevent it from burning (step S08). When a better driving voltage is chosen, the gate driving circuit 20 can be driven correctly. The display device 1 shows a correct image and the activation procedure of the display device 1 is finished (step S09).

During the operation period, the temperature sensing portion 301 continuously senses ambient temperature to check whether the present temperature varies from the previous temperature (step S10). If there is a temperature variation, the temperature sensing portion 301 will output the temperature compensation voltage Vtemp to the pulse width modulation portion 303 according to the present temperature (step S11), and the procedure proceeds to step S12. If there is no temperature variation, temperature compensation will be unnecessary, and the procedure proceeds to step S12. Next, whether the normal feedback signal pattern is obtained is checked (step S12). If the normal feedback signal pattern is obtained, temperature compensation will be enough to compensate the driving voltage and the procedure proceeds back to step S09. If the normal feedback signal pattern is not obtained, the current meter 305 (or 305') will be further utilized to check whether the current of the high voltage level VGH or the current of the first low voltage level VGL_Gate is unusually high (step S23). If the current meter 305 (305') detects an abnormal current value, there may be current leakage. Whether the duty cycle of the driving voltage (for example clock signals CLKn) is 0 is checked (step S34). If the duty cycle is not 0, the duty cycle of the driving voltage can be shortened. Current leakage is lowered by shortening the duty cycle of the driving voltage (step S35), and the procedure proceeds back to step S12 to check again whether the normal feedback signal pattern is obtained. On the other hand, if the duty cycle is 0, the panel may be dysfunctional and the display device is shut down or driven by a lower predetermined voltage to prevent it from burning (step S15). If the current meter 305 (305') detects a normal current value, the driving capacity of the driving voltage may be insufficient. At step S36, whether the duty cycle of the driving voltage has reached the maximum value is checked. If the duty cycle has not reached the maximum value, the duty cycle of the driving voltage can be extended to increase the driving capacity of the driving voltage (step S37), and the procedure proceeds back to step S12 to check again whether the normal feedback signal pattern is obtained. If the duty cycle of the driving voltage has reached the maximum value, the duty cycle cannot be further extended. The panel is dysfunctional and the display device is shut down or driven by a lower predetermined voltage to prevent it from burning (step S15).

According to the display device and the driving method in accordance with Embodiments 1 and 2, that the display device is booted correctly can be ensured, or the life time of the display device can be extended. Moreover, the current leakage of the display device can be lowered.

While the disclosure has been described by way of example and in terms of the preferred embodiments, it is to be understood that the disclosure is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A display device, comprising:

a display panel;

a gate driving circuit disposed on the display panel and sequentially outputting a plurality of scan signals and at least one dummy scan signal; and a driving module electrically connected with the gate driving circuit and outputting a plurality of clock signals to the gate driving circuit, wherein the driving module receives a feedback signal from the gate driving circuit and adjusts the clock signals according to the feedback signal, and the driving module comprises:

a feedback detection portion receiving the feedback signal and outputting a feedback compensation voltage;

a pulse width modulation portion receiving the feedback compensation voltage and outputting a high voltage and a low voltage, wherein the high voltage comprises a predetermined voltage and the feedback compensation voltage; and a level shift portion receiving the high voltage and the low voltage and generating the clock signals.

2. The display device as claimed in claim 1, wherein when the driving module receives the feedback signal with an abnormal pattern, the driving module adjusts a voltage difference of the clock signals.

3. The display device as claimed in claim 1, wherein the feedback signal includes the at least one dummy scan signal.

4. The display device as claimed in claim 1, wherein the driving module further comprises:

a current meter disposed between and electrically connected with the pulse width modulation portion and the level shift portion to detect a current corresponding to the high voltage or the low voltage output from the pulse width modulation portion.

5. A display device, comprising:

a first gate driving circuit formed on a side of the display panel and sequentially outputting a plurality of scan signals and a first dummy scan signal;

a second gate driving circuit formed on an opposite side of the display panel and sequentially outputting the plurality of scan signals and a second dummy scan signal; and a driving module outputting a plurality of clock signals to the first gate driving circuit and the second gate driving circuit, wherein the driving module receives a first feedback signal from the first gate driving circuit and a second feedback signal from the second gate driving circuit, and the driving module adjusts the clock signals according to the first feedback signal or the second feedback signal, and the driving module comprises:

a feedback detection portion receiving at least one of the first feedback signal and the second feedback signal, and the feedback detection portion outputting a feedback compensation voltage;

a pulse width modulation portion receiving the feedback compensation voltage and outputting a high voltage and a low voltage, wherein the high voltage comprises a predetermined voltage and the feedback compensation voltage; and a level shift portion receiving the high voltage and the low voltage and generating the clock signals.

6. The display device as claimed in claim 5, wherein when the driving module receives the first feedback signal with an abnormal pattern, the driving module adjusts a voltage difference of the clock signals.

7. The display device as claimed in claim 5, wherein when the driving module receives the second feedback signal with an abnormal pattern, the driving module adjusts a voltage difference of the clock signals.

8. The display device as claimed in claim 5, wherein the first feedback signal includes the first dummy scan signal.

9. The display device as claimed in claim 5, wherein the second feedback signal includes the second dummy scan signal.

10. The display device as claimed in claim 5, wherein the first feedback signal and the second feedback signal are received at different time points.

11. The display device as claimed in claim 5, wherein the high voltage further comprises a temperature compensation voltage.

12. The display device as claimed in claim 5, wherein the driving module further comprises:

a current meter disposed between and electrically connecting with the pulse width modulation portion and the level shift portion to detect a current of the high voltage or the low voltage output from the pulse width modulation portion.

13. A driving method of a display device, comprising:

providing the display device, the display device comprising:

a display panel;

a gate driving circuit disposed on the display panel; and a driving module electrically connected with the gate driving circuit and outputting a plurality of clock signals to the gate driving circuit, wherein the driving module receives a feedback signal from the gate driving circuit and adjusts the clock signals according to the feedback signal;

activating the display device;

raising a voltage difference of the clock signals when the driving module receives the feedback signal with an abnormal pattern during an activation period of the display device until the driving module receives the feedback signal with a normal pattern; and shutting down the display device if the voltage difference of the clock signals is raised to a maximum value, and the driving module has not received the feedback signal with the normal pattern.

14. The driving method as claimed in claim 13, further comprising:

raising the voltage difference of the clock signals when the driving module receives the feedback signal with the abnormal pattern during an operation period of the display device until the driving module receives the feedback signal with the normal pattern.

15. The driving method as claimed in claim 14, further comprising:

detecting an output current of the driving module by using a current meter during the operation period of the display device;

determining whether the output current of the driving module is normal when the driving module receives the feedback signal with the abnormal pattern;

in cases where the output current of the driving module is normal, raising the voltage difference of the clock signals until the driving module receives the feedback signal with the normal pattern; and in cases where the output current of the driving module is abnormal, lowering the voltage difference of the clock signals until the driving module receives the feedback signal with the normal pattern.

16. The driving method as claimed in claim 14, further comprising:

detecting the output current of the driving module by using a current meter during the operation period of the display device;

determining whether the output current of the driving module is normal when the driving module receives the feedback signal with the abnormal pattern;

in cases where the output current of the driving module is normal, extending the duty cycle of the clock signals until the driving module receives the feedback signal with the normal pattern;

in cases where the output current of the driving module is abnormal, shortening the duty cycle of the clock signals until the driving module receives the feedback signal with the normal pattern.

17. The driving method as claimed in claim 13, further comprising:

sensing an ambient temperature; and when the ambient temperature deviates from a default temperature, adjusting the voltage difference of the clock signal output from the driving module according to the ambient temperature.

* * * * *